United States Patent [19]

Henrich

[11] 4,304,557

[45] Dec. 8, 1981

[54] HYDRO TORQUE SKEG FOIL

[75] Inventor: Donald A. Henrich, Lake Villa, Ill.

[73] Assignee: Outboard Marine Corporation, Waukegan, Ill.

[21] Appl. No.: 110,128

[22] Filed: Jan. 4, 1980

[51] Int. Cl.[3] ..... B63H 21/26

[52] U.S. Cl. ..... 440/66; 440/78

[58] Field of Search ..... 440/49, 66, 76, 78, 440/89

[56] References Cited

U.S. PATENT DOCUMENTS

| | | | |
|---|---|---|---|
| 803,671 | 11/1905 | Curtis | 440/66 |
| 1,580,486 | 4/1926 | Hass | 440/66 |
| 1,610,678 | 12/1926 | Hiorth | 440/66 |
| 1,716,962 | 6/1929 | Johnson | 440/76 |
| 2,847,967 | 8/1958 | Kiekhaefer | 440/78 |
| 3,537,419 | 11/1970 | Holtermann et al. | 440/66 |
| 3,799,103 | 3/1974 | Granholm | 440/66 |
| 3,817,202 | 6/1974 | Holtermann | 440/66 |

FOREIGN PATENT DOCUMENTS

| | | | |
|---|---|---|---|
| 281729 | 1/1929 | United Kingdom | 440/66 |

*Primary Examiner*—Johnny D. Cherry

*Attorney, Agent, or Firm*—Michael, Best & Friedrich

[57] ABSTRACT

Disclosed herein is a marine propulsion device including a downwardly extending propulsion leg, the lower end of the propulsion leg including a gear case, a drive shaft housed in the propulsion leg, a propeller shaft located in the gear case, and a propeller mounted on the propeller shaft, rotary operation of the marine propulsion device producing a steering torque on the propulsion leg. The propulsion leg also includes a skeg extending downwardly from the gear case, the rearward edge of the skeg comprising a foil for producing a torque on the propulsion leg opposite to the torque produced by rotary operation of the marine propulsion device.

8 Claims, 3 Drawing Figures

HYDRO TORQUE SKEG FOIL

FIELD OF THE INVENTION

The invention relates generally to marine propulsion devices such as stern drive units and outboard motors, and more particularly to the employment of a foil positioned on the gear case skeg and functioning to counteract steering torque on the lower unit by rotary operation of the marine propulsion device and to thereby make steering easier.

BACKGROUND PRIOR ART

An example of an outboard motor including a skeg on the propulsion leg and wherein the skeg provides a means for generating a force which counteracts the steering torque on the propulsion leg is illustrated in the Kiekhaefer U.S. Pat. No. 2,847,967, issued Aug. 19, 1958.

Attention is also directed to the Holtermann U.S. Pat. No. 3,817,202, issued June 18, 1974; the Granholm U.S. Pat. No. 3,799,103, issued Mar. 26, 1974; and the Holtermann U.S. Pat. No. 3,537,419, issued Nov. 3, 1970.

Attention is also directed to the Shimanckas U.S. Pat. No. 3,183,880, issued May 18, 1965; and to the Bennett U.S. Pat. No. 3,437,069, issued Apr. 8, 1969.

SUMMARY OF THE INVENTION

The invention includes a marine propulsion device including a downwardly extending propulsion leg, a drive shaft housed in the propulsion leg and including a lower end having a gear case, a propeller shaft located in the gear case, and a propeller mounted on the propeller shaft whereby rotary operation of the marine propulsion device produces a steering torque on the propulsion leg. A skeg extends downwardly from the gear case, the skeg including a body portion having a rearward edge. The skeg also includes means for producing a torque on the propulsion leg opposite to the torque produced by rotary operation of the marine propulsion device, the torque producing means including a foil extending from the rearward edge of the body portion of the skeg, the foil being removably secured to the rearward edge of the body portion of the skeg.

The invention also includes a marine propulsion device comprising a downwardly extending propulsion leg, a drive shaft housed in the propulsion leg and including a lower end having a gear case, a propeller shaft located in the gear case, and a propeller mounted on the propeller shaft, whereby rotary operation of the marine propulsion device produces a steering torque on the propulsion leg. The lower end of the propulsion leg also includes a skeg extending downwardly from the gear case, the skeg having a pair of opposite lateral surfaces and a rearward portion having a configuration producing a steering torque on the propulsion leg opposite to the torque produced by rotary operation of the marine propulsion device. The rearward portion of the skeg includes a convex surface extending from the gear case to the lower end of the skeg, and an opposite positive pressure surface extending from the gear case to the lower end of the skeg.

Other features and advantages of the invention will be apparent with reference to the following description, the claims and the drawings.

BRIEF DESCRIPTIONS OF THE DRAWINGS

Figure 1:
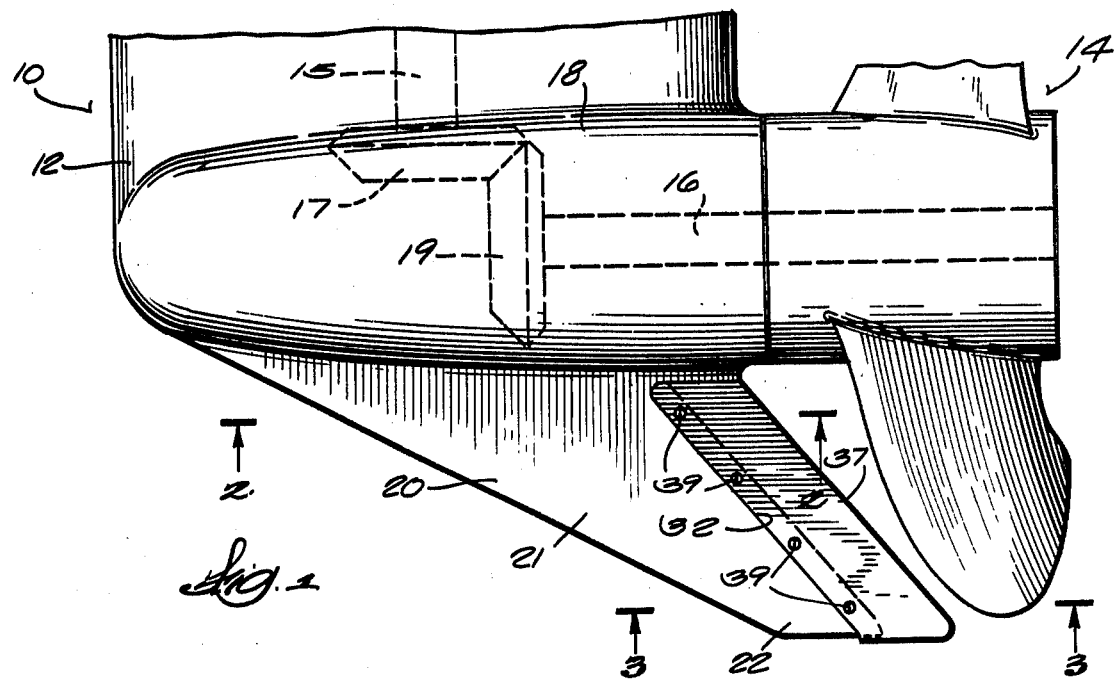
FIG. 1 is a fragmentary elevation view of one embodiment of a lower unit of a marine propulsion device embodying the features of the invention.

Before explaining the invention in detail, it is to be understood that the invention is not limited in its application to the details of construction and the arrangement of the components set forth in the following description or illustrated in the drawings. The invention is capable of other embodiments and of being practiced and carried out in various ways. Also, it should be understood that the phraseology and terminology employed herein is for the purpose of description and should not be regarded as limiting.

DESCRIPTION OF THE PREFERRED EMBODIMENT

The invention is applicable to marine propulsion arrangements including outboard motors and stern drive units. Such propulsion arrangements include means for rotatably supporting a propeller which includes a hub and one or more extending blades and which is operably connected to an engine. In this regard, there is fragmentarily shown in the drawings a marine propulsion device 10 which can be either a stern drive unit or an outboard motor and which includes a propulsion or lower unit 12 rotatably supporting a propeller 14. The propeller 14 is generally rotatable about the axis of a propeller shaft 16, and the propeller shaft 16 is connected to an engine (not shown) by means of a drive shaft 15 and bevel gears 17 and 19, the bevel gears 17 and 19 being located in a gear case 18. The propulsion leg 12 also includes a skeg 20 which extends downwardly from the gear case 18 and terminates in a lower end 22.

In certain types of outboard motors and stern drive units, rotary operation of the marine propulsion unit generates a torque on the lower unit 12 tending to cause pivotal steering movement of the lower unit.

Means are also provided for producing a torque on the lower unit 12 opposite to the torque generated by rotary operation of the marine propulsion device to thereby reduce the tendency of the lower unit 12 to pivot about the steering axis and to thereby make steering of the marine propulsion unit easier. In one preferred form of the invention, the skeg 20 is constructed for producing a reverse torque on the lower unit 12 and includes a rearward portion thereof with a cross sectional configuration having an airfoil shape, the airfoil cross section portion extending from adjacent the gear case 18 to the lower end 22 of the skeg 20.

More particularly, at least a portion of one of the lateral sides of the skeg 20 comprises a positive pressure surface 23 extending downwardly and rearwardly from the gear case 18 to the lower end 22 of the skeg 20. In the illustrated arrangement, the positive pressure surface 23 has a slightly concave configuration with respect to an axis extending downwardly from the gearcase to the lower end of the skeg. At least a portion of the opposite lateral side of the skeg 20 forms a complementary negative pressure surface 25 which is somewhat convex with respect to an axis extending from the gear case to the lower end of the skeg. By providing the skeg with this configuration, during movement of the skeg through the water, a low pressure area will form adjacent the convex surface 25 of the skeg, thereby generating a force F in the direction opposite to the direction of the force produced by rotary operation of the marine propulsion device.

While a skeg 20 constructed in accordance with the invention can have various configurations, in the arrangement illustrated in the drawings, the forward body portion 21 of the skeg 20 has a generally conventional configuration, and a foil 30 is adapted to be removably secured to the rearward edge 32 of the body portion 21 of the skeg 20, the foil 30 generally having an airfoil cross sectional shape so as to produce a lateral force on the propulsion leg 12 as water flows past the foil 30. More particularly, the foil 30 generally comprises an elongated member extending from the gearcase 18 to the lower end 22 of the skeg 20 and includes a leading edge 36 sloping downwardly and rearwardly and a rearward edge 37 also sloping downwardly and rearwardly, the leading edge 36 particularly shaped so as to mate with the rearward edge 32 of the body portion 21 of the skeg 20 and including a plurality of bores 38 whereby screws 39 can secure the foil 20 to the rearward edge 32. The rearward edge 32 of the body portion 21 of the skeg 20 shown in the drawings has a stepped configuration, when viewed in horizontal cross section, complementary to the stepped configuration of the leading edge 36 of the foil 30.

Figure 2:
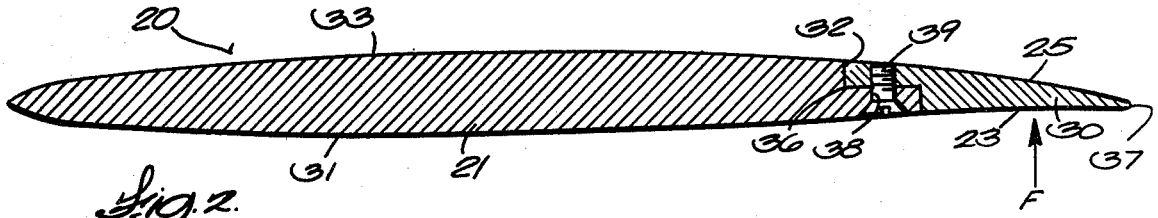
FIG. 2 is a cross section view taken along line 2—2 in FIG. 1.
Figure 3:
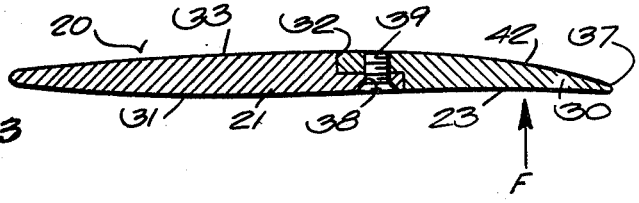
FIG. 3 is a cross section view taken along line 3—3 in FIG. 1.

As shown in cross section in FIGS. 2 and 3, one lateral surface of the foil 30 forms the concave positive pressure surface 23 and the opposite lateral surface of the foil 30 forms the convex negative pressure surface 25. It should be noted that this cross sectional configuration of the foil 30 extends from a point adjacent the gear box downwardly to the lower end 22 of the skeg 20. The lateral surfaces 31 and 33 of the body portion 21 of the skeg 20 are shaped so that, when the foil 30 is fixed to the body portion 21 of the skeg, the lateral surfaces 31 and 33 of the body portion of the skeg and the lateral surfaces 23 and 25 of the foil, respectively, produce continuous lateral surfaces extending from the forward to the rearward edge of the skeg. One of the lateral surfaces will have a convex configuration from the forward edge to the rearward edge of the skeg. The other of the lateral surfaces will have a forward portion with a convex configuration and a rearward portion thereof having a concave configuration.

One of the advantages of the embodiment of the invention employing the foil 30 attached to the rearward edge 32 of the skeg 20 is that various foils having alternative shapes can be fastened to the skeg 20 depending upon the type of propeller 14 employed with the marine propulsion device. For example, if the propeller 14 is removed and a propeller 14 having an alternative configuration is employed, the foil 30 can also be removed and a foil having a configuration particularly adapted for use with the new propeller can be employed.

Another of the advantages of the use of the removable foil 30 is that different foils can be employed depending upon whether the motor has a clockwise or counterclockwise rotating propeller. In cases where two marine outboards are employed on a boat, it is desirable that the propellers be counter rotating to obtain maximum performance from the outboards. By providing a removable foil, at the time that one of the motors is modified so as to provide reverse rotation of one of the propellers, a foil having a proper cross sectional configuration can also be added.

Various features of the invention are set forth in the following claims.

I claim:

1. A marine propulsion device comprising a downwardly extending propulsion leg including a lower end having a gear case, a drive shaft housed in said propulsion leg, a propeller shaft located in said gear case and driven by said drive shaft, a propeller mounted on said propeller shaft, whereby rotary operation of the marine propulsion device produces a steering torque on the propulsion leg, a skeg extending downwardly from said gear case, said skeg including a body portion having a rearward edge, and means for producing a torque on said propulsion leg opposite to the torque produced by rotary operation of the marine propulsion device, said torque producing means including a foil removeably secured to said rearward edge of said body portion.

2. A marine propulsion device as set forth in claim 1 wherein said foil comprises an elongated blade having a forward edge, a rearward edge, opposite lateral surfaces and a thickness which decreases from said forward edge to said rearward edge, wherein said body portion includes opposite lateral surfaces, and wherein said foil is secured to said body portion such that said lateral surfaces of said body portion and said foil form continuous surfaces.

3. A marine propulsion device as set forth in claim 1 wherein said foil is bolted to said body portion.

4. A marine propulsion device as set forth in claim 1 wherein said foil has a cross sectional configuration generally having an airfoil shape, and wherein said foil includes a positive pressure surface having a concave configuration and a negative pressure surface having a convex configuration and being opposite said positive pressure surface.

5. A marine propulsion device as set forth in claim 4 wherein said skeg has a lower end and wherein said foil includes opposite ends, one of said ends being adjacent said gear case and the other of said ends being adjacent to said skeg lower end.

6. A marine propulsion device as set forth in claim 5 wherein said foil includes a forward edge sloping downwardly and rearwardly and a rearward edge sloping downwardly and rearwardly.

7. A marine propulsion device as set forth in claim 1 wherein said skeg includes a forward edge and opposite lateral surfaces, one of said lateral surfaces having a convex-configuration from said forward edge to said rearward edge, and the other of said lateral surfaces including a forward portion having a convex configuration and a rearward portion having a concave configuration, said concave portion being continuous with said convex portion of said other of said lateral surfaces.

8. A marine propulsion device comprising a downwardly extending propulsion leg including a lower end having a gear case, a drive shaft housed in said propulsion leg, a propeller shaft located in said gear case and driven by said drive shaft, a propeller mounted on said propeller shaft, whereby rotary operation of the marine propulsion device produces a steering torque on said propulsion leg, a skeg extending downwardly from said gear case, said skeg having a pair of opposite lateral surfaces, and a rearward portion having a configuration producing a steering torque on said propulsion leg when water flows past said skeg and opposite to the steering torque produced by rotary operation of the marine propulsion device, one of said lateral surfaces including a rearward portion comprising a convex surface extending substantially from said gear case to the lower end of said skeg, and the other of said lateral surfaces including a rearward portion comprising a positive pressure surface extending substantially from said gear case to said lower end of said skeg.

* * * * *